United States Patent [19]

Wu

[11] Patent Number: 4,684,914

[45] Date of Patent: Aug. 4, 1987

[54] COMBINATION PLUG

[76] Inventor: Zei C. Wu, No. 53-2, Lin 8, Hsiang Shan Li, Hsin Chu City, Taiwan

[21] Appl. No.: 919,684

[22] Filed: Oct. 16, 1986

[51] Int. Cl.[4] ..... H01H 85/02

[52] U.S. Cl. ..... 337/198; 439/622

[58] Field of Search ..... 337/198, 197, 216; 339/147 P

[56] References Cited

U.S. PATENT DOCUMENTS 4,274,698 6/1981 Ahroni ..... 337/198

4,592,613 6/1986 Tong ..... 339/147 P

*Primary Examiner*—Harold Broome

*Attorney, Agent, or Firm*—Steinberg & Raskin

[57] ABSTRACT

A plug having an outer housing and an insert. The insert comprises fuse blocks and prongs. The outer housing has a sliding door for checking and/or changing the fuses. The outer housing also has a conduction wire inlet, through which the conduction wires fit, and prong holes through which the prongs of the insert can fit, so as to allow for easy assemblage of the plug. The insert slideably fits into the outer housing.

1 Claim, 3 Drawing Figures

COMBINATION PLUG

BACKGROUND OF THE INVENTION

This invention relates to a combination plug having an insert which fits into an outer housing and also having a slideable door on the outer housing through which the fuse block is serviceable. In the past, plugs did not have easily observable and serviceable fuse portions and were not easily assembled.

It is the purpose of this present invention, therefore, to mitigate and/or obviate the abovementioned drawbacks in the manner set forth in the detailed description of the preferred embodiment.

SUMMARY

A primary objective of this invention is to provide a combination plug which is easily combined during assembly.

Another objective of this invention is to provide a combination plug which has a sliding door for checking and maintaining fuses within the combination plug.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
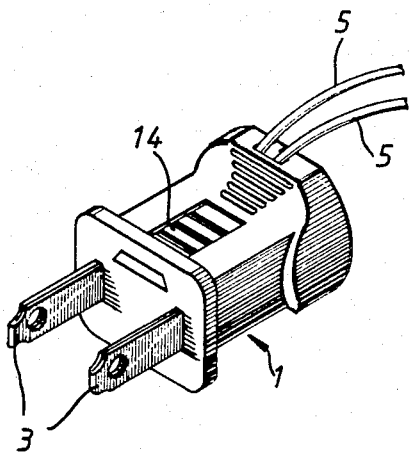
FIG. 1 is a perspective view of the present invention.
Figure 2:
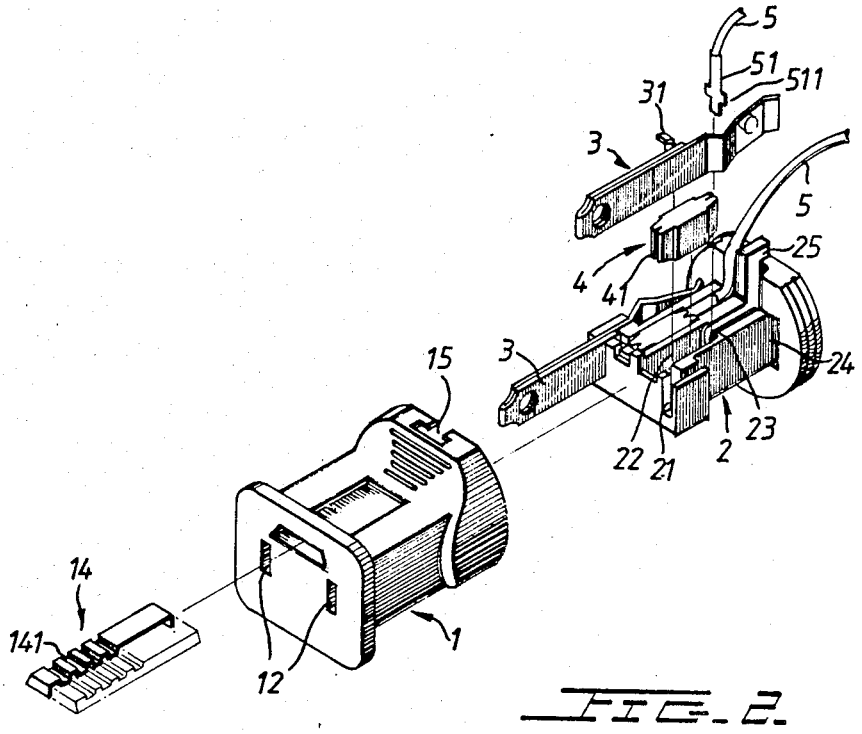
FIG. 2 is an exploded view of the present invention.

Referring to FIG. 1, it can be seen that the present invention comprises an outer housing 1 which has a sliding door 14. As seen from FIG. 2, an insert housing 2 can be fitted into the outer housing 1. The insert housing 2 comprises two prongs 3, two fuse blocks 4 and conduction wire 5.

A fuse 41 is disposed on each of the two fuse blocks 4. The two fuse blocks 4 fit conveniently into the two fuse slots 22, respectively. The fuse blocks 4 also respectively secure the lugs 511 off the conduction wire plates 51 into the fuse slots 22. Conduction prongs 3 fit into the prong slots 21. These conduction prongs 3 have a branch 31 which completes the electrical pathway from the conduction wire 5 to the fuse 41 to the prong 3. The conduction wire fits into grooves 23 on the insert housing 2 and extend thru the conduction wire inlet 15 on the outer housing 1.

The whole insert portion 2 of the present invention fits into the outer housing 1 so that the conduction prongs 3 fit through the prong holes 12 of the outer housing 1. When the insert housing 2 is thus engaged with the outer housing 1, the sliding door 14 may be used to check and service the fuses 41 or the contact between the conduction plates 51 and the fuses 41. If a fuse 41 is burnt out, it can be conveniently and quickly changed through the sliding door 14. The sliding door 14 also has a plurality of grooves 141 which make gripping the sliding door 14 easy.

Figure 3:
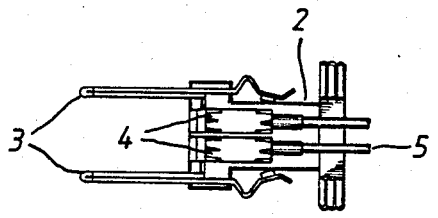
FIG. 3 is a top view of the insert portion of the present invention.

From FIG. 3, a top view of the assembled insert housing 2 can be seen. The bent portion of the prong 3 simply stabilizes the prong between the insert wall 24 and the inside wall (not shown) of the outer housing 1. A divider 25 insures the separation of the conduction wires 5.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. A combination plug comprising:

an outer housing; said outer housing comprising a sliding door with grooves, two prong holes, and a conduction wire inlet;

an insert housing; said insert housing comprising two prong slots, two fuse slots, two grooves, two insert walls, and a divider;

two prongs; each of said two prongs having a branch;

two fuse blocks; each of said two fuse blocks having a fuse thereon;

conduction wires; said conduction wires having conduction plates on an end thereof being inserted into said two fuse slots; said two fuse blocks being placed in each of said two fuse slots;

said sliding door being slideably insertable into said outer housing so as to provide a means for checking and maintaining said two fuses; said insert housing being slideably insertable in said outer housing with said prongs fitting through said prong holes; said conduction plates being electrically connected to said fuses, and said fuses being electrically connected to said branches.

* * * * *